US007681338B2

(12) United States Patent
Hall et al.

(10) Patent No.: US 7,681,338 B2
(45) Date of Patent: Mar. 23, 2010

(54) ROLLING ASSEMBLY AND PICK ASSEMBLY MOUNTED ON A TRENCHER

(76) Inventors: David R. Hall, 2185 S. Larsen Pkwy., Provo, UT (US) 84606; Ronald Crockett, 2185 S. Larsen Pkwy., Provo, UT (US) 84606; Sigmar Tobias, 2185 S. Larsen Pkwy., Provo, UT (US) 84606

( * ) Notice: Subject to any disclaimer, the term of this patent is extended or adjusted under 35 U.S.C. 154(b) by 241 days.

(21) Appl. No.: 11/871,878

(22) Filed: Oct. 12, 2007

(65) Prior Publication Data

US 2008/0283256 A1 Nov. 20, 2008

Related U.S. Application Data

(63) Continuation-in-part of application No. 11/748,184, filed on May 14, 2007, and a continuation-in-part of application No. 11/673,634, filed on Feb. 12, 2007.

(51) Int. Cl.
*E02F 5/02* (2006.01)

(52) U.S. Cl. ..... 37/347; 37/460

(58) Field of Classification Search ..... 37/347, 37/352, 365, 91–97, 446–460, 462–465; 175/426, 428, 432, 374, 227, 371; 137/68.1, 137/68.23, 68.27, 846

See application file for complete search history.

(56) References Cited

U.S. PATENT DOCUMENTS 4,035,024 A 7/1977 Fink
4,189,183 A 2/1980 Borowski
4,548,442 A 10/1985 Sugden
5,074,063 A 12/1991 Vannette
5,219,380 A 6/1993 Young
5,295,735 A 3/1994 Cobbs
5,392,540 A 2/1995 Cooper
RE35,088 E 11/1995 Gilbert
5,490,339 A 2/1996 Accettola
5,655,614 A * 8/1997 Azar ..... 175/404
6,092,611 A * 7/2000 Saxman ..... 175/227
6,105,694 A * 8/2000 Scott ..... 175/428
6,248,447 B1 * 6/2001 Griffin et al. ..... 428/408
6,341,823 B1 1/2002 Sollami
6,457,267 B1 10/2002 Porter
6,543,963 B2 4/2003 Bruso
6,779,948 B2 8/2004 Bruso
6,854,201 B1 2/2005 Hunter
7,150,131 B2 12/2006 Barker
7,152,702 B1 * 12/2006 Bhome et al. ..... 175/384

* cited by examiner

*Primary Examiner*—Robert E Pezzuto
(74) *Attorney, Agent, or Firm*—Tyson J. Wilde; Derek J. Battisti; Philip W. Townsend, III

(57) ABSTRACT

In one aspect of the present invention, a roller assembly on an excavator for degrading natural and man-made formations has a plurality of pointed inserts disposed along its outer diameter. The inserts have a tip adapted to impact the formation and at least one of the tips has polycrystalline diamond bonded to a cemented metal carbide segment. The diamond also has a substantially conical geometry with a 0.50 to 0.200 inch radius and a thickness greater that 100 inches at the apex. The diamond also has a volume that is 75 to 150 percent of a volume of a carbide substrate.

19 Claims, 10 Drawing Sheets

ROLLING ASSEMBLY AND PICK ASSEMBLY MOUNTED ON A TRENCHER

CROSS REFERENCE TO RELATED APPLICATIONS

This application is a continuation in-part of U.S. patent application Ser. No. 11/748,184 which was filed on May 14, 2007 and is herein incorporated by reference for all that it discloses.

This application is also a continuation-in-part of U.S. patent application Ser. No. 11/673,634 which was filed on Feb. 12, 2007 and is herein incorporated by reference for all that it discloses.

BACKGROUND OF THE INVENTION

In the trenching industry, earth may be degraded using picks or teeth to break up minerals and rocks. Picks are generally attached to chain driven assemblies and are used for excavating large amounts of hard materials. In trenching, a chain supporting an array of picks may rotate such that the picks engage a surface causing it to break up.

Examples of degradation assemblies from the prior art are disclosed in U.S. Pat. No. 6,824,225 to Stiffler, which is herein incorporated by reference for all that is contains discloses a rotatable cutting bit, and rotatable cutting bit holder assembly and washer that have increased wear resistance characteristics. The assembly incorporates a new holding washer design that has improved rotational characteristics between the cutter bit and top surface of the washer during operation.

U.S. Pat. No. 6,854,810 to Montgomery, Jr., which are all herein incorporated by reference for all that it contains discloses a wear sleeve in a cutter tool assembly that comprises a rearward split ring portion and an intermediate cylindrical ring portion adjacent a forward shoulder portion The outer diameter of the wear sleeve intermediate portion and rearward split ring portion is uniform. The wear sleeve is inserted into the bit holder's stepped bore aperture. The split ring portion is radially compressed by the smaller diameter rearward end as the sleeve is hammered and axially displaced into the bit holder.

The picks typically have a tungsten carbide tip. Efforts have been made to extend the life of these pointed inserts. Examples of such efforts are disclosed in U.S. Pat. No. 6,051,079 to Andersson et al., U.S. Pat. No. 5,417,475 to Graham et al., U.S. Pat. No. 6,733,087 to Hall et al., all of which are herein incorporated by reference for all that they disclose.

BRIEF SUMMARY OF THE INVENTION

A trenching machine for degrading natural and man made formations comprising a roller assembly exteriorly mounted to a chain driven assembly. The roller assembly comprises a plurality of pointed inserts disposed along its outer diameter. The inserts comprise a tip adapted to impact the formation. The trenching machine also comprises a pick assembly exteriorly mounted to the chain driven assembly.

The roller assembly may leave waves or groves in the formation during the trenching process and the pick assembly may be adapted to break any grove or wave left by the roller assembly. The pick assembly may be disposed in a holder that comprises a taper adapted to pass through the formation. The taper may increase from a bottom portion of the pick assembly. The pick assembly and the roller assembly may be bolted, welded, or combination thereof to the chain driven assembly. The pick assembly may further comprise a spring mechanism, which may aid in extending the life of the pick assembly. The roller assembly and the pick assembly may be attached to a link of the chain driven assembly with the pick assembly comprising a positive or negative rake angle. In some embodiments the roller assembly may be offset in direction relative to the link.

The pick assembly may comprise a superhard material selected from the group consisting of cubic boron nitride, diamond, diamond like material, or combinations thereof and may be disposed posterior the roller assembly. The pick assembly may further comprise a bottom portion opposite an end with a pointed geometry with a space intermediate the bottom portion and the holder. The pick assembly may also rotate within the holder. This may aid in resisting wear to a single portion of the pick assembly. The pick assembly may also comprise a lubrication system which may aid in resisting wear to the pick assembly. The roller assembly may also comprise a lubrication system adapted to reduce wear to the roller assembly. The chain driven assembly may comprise a plurality of roller assemblies that may comprise a roller assembly with a different number of pointed inserts than another roller assembly.

The pick assembly may comprise a shear cutter adapted to contact the formation. The pick assembly comprising a shear cutter or a pointed geometry may degrade the wave formation left by the roller assembly. The roller assembly and pick assembly may be connected to a single link and may be within several inches of one another. The width of the pick assembly may be equal to the width of the roller assembly. The link may be part of the chain driven assembly which may be part of a coal mining machine, a trenching machine, or an asphalt milling machine.

In another aspect of the invention, a method comprising the steps of providing a roller assembly exteriorly mounted to a chain driven assembly, and the rollers comprising a plurality of pointed inserts disposed along its outer diameter. The inserts may comprise a tip adapted to impact the formation. The chain driven assembly may be positioned adjacent to the formation. The formation may be degraded by the inserts attached to holders by activating the chain driven assembly. A pick assembly may be positioned posterior the roller assembly in order to facilitate the removal of the degraded formation.

DETAILED DESCRIPTION OF THE INVENTION AND THE PREFERRED EMBODIMENT

Figure 1:
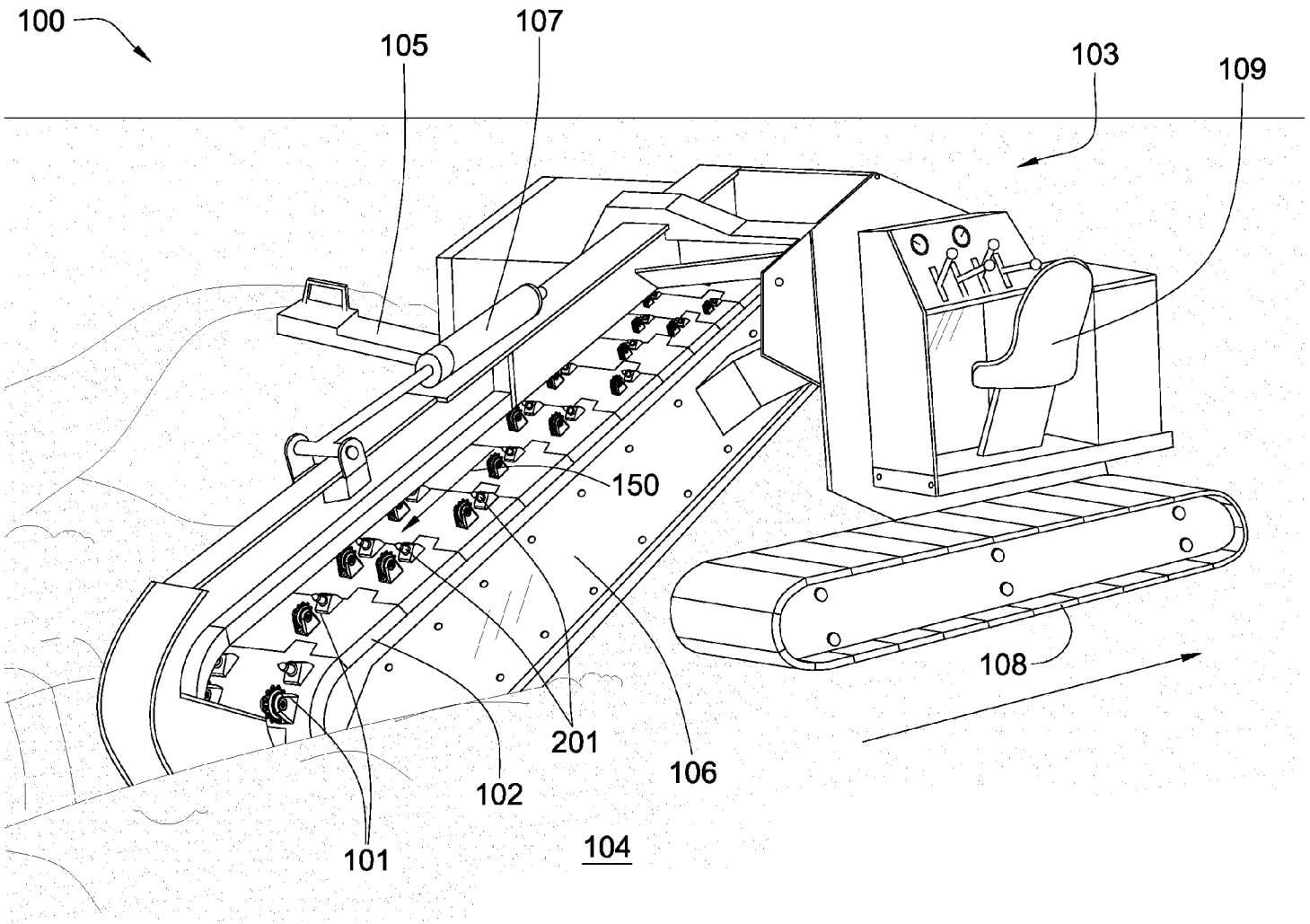
FIG. 1 is a perspective diagram of an embodiment of a trenching machine.

FIG. 1 is a perspective diagram of an embodiment of a trenching machine 100. FIG. 1 shows a plurality of roller assemblies 101 on a chain driven assembly 102 attached to a motor vehicle 103. The plurality of roller assemblies 101 may be exteriorly mounted in a "V" pattern on the chain 102 to facilitate degradation and removal of a formation 104. Posterior the roller assembly may be a pick assembly 201 to facilitate degradation of the formation 104. The rotating chain 102 rotates in the direction of the arrow 150 and cuts the formation 104 forming a trench while bringing the formation 104 cuttings out of the trench to a conveyor belt 105 which directs the cuttings to a side of the trench. The chain driven assembly 102 is supported by an arm 106. The arm 106 may be raised while the trenching machine 100 is being transported or it may be lowered for trenching as shown in FIG. 1. The position of the arm 106 may be controlled by a hydraulic piston and cylinder 107. The trenching machine may move about the formation 104 by tracks 108, wheels, or a combination thereof. A seat 109 for an operator is positioned on the side of the trenching machine 100.

Figure 2:
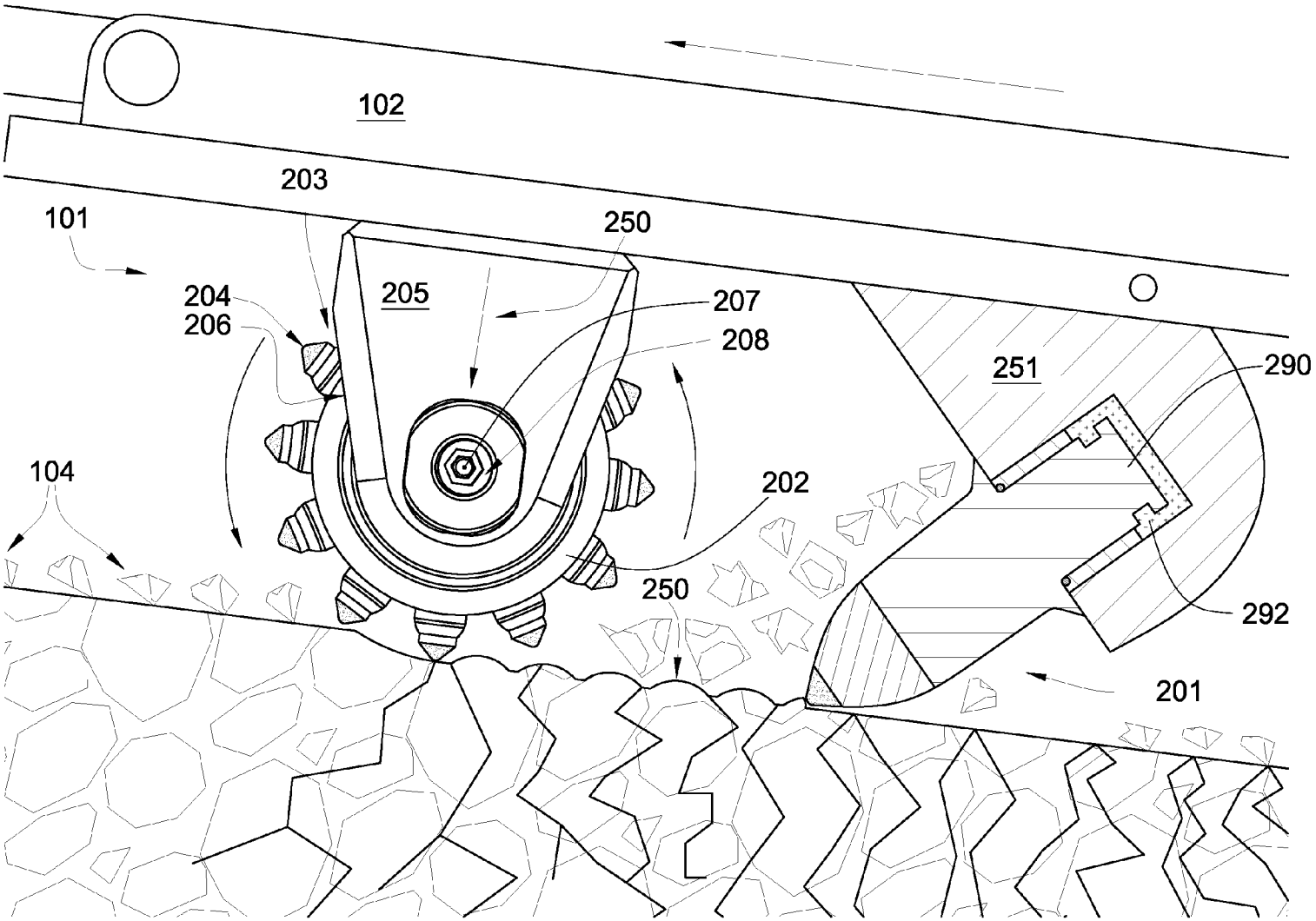
FIG. 2 is an orthogonal diagram of an embodiment of a roller assembly and a pick assembly.

FIG. 2 is a perspective diagram of an embodiment of a roller assembly 101 degrading a formation 104 along with a pick assembly 201 positioned posterior to the roller assembly 101 adapted to degrade the formation 104. The roller assembly 101 may comprise a rotating wheel 202 in order to facilitate the degrading of the formation 104. The wheel 202 may comprise pointed inserts 203 that are disposed on its outer diameter. The pointed inserts 203 may further comprise an impact tip 204 to further facilitate the degrading of a formation 104. The wheel 202 may be interiorly connected to a housing 205 that is welded to the chain driven assembly 102. The housing 205 may comprise a saddle 206 shaped interior about which the wheel 202 rotates therein. The saddle 206 may have a width of 1 to 3 inches, and the wheel 202 may have a thickness of 0.8 to 2.8 inches. In order for the wheel 202 to be attached a threaded axle 207 may run through a nut 208 and along the central axis of the wheel 202 attaching the wheel 202 to the housing 205. The wheel 202 freely rotates about this axle 207. The nut 208 may facilitate the removal of the wheel 202.

Force is applied in the direction of arrow 250 loading pressure on the pointed inserts 203. As the wheel 202 rotates about the axle 207 the pointed inserts 203 may rotationally engage the formation 104. The pointed inserts 203 may engage the surface at the impact tip 204, which may be optimized for the wear life of the roller assembly 101. Wear life may be improved because the rotating motion reduces the effects of drag and eventual wear on the pointed inserts 203. The housing 205, the wheel 202, and the pointed inserts 203 may comprise or be coated by a hard material to prevent wear.

The impact tips 204 may comprise a superhard material opposite a bottom portion 290 which may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof The superhard material may be a polycrystalline structure with an average grain size of 0.000394 to 0.0394 inches. The roller assembly 101 may create a wave geometry 250 in the formation 104. The pick assembly 201 may be adapted to contact the wave geometry in the formation 104 and facilitate the degrading of the formation 104. The pick assembly 201 may be disposed within a holder 251 that is attached to the chain driven assembly 102. The pick assembly 201 may also comprise a lubrication system 292.

Figure 3:
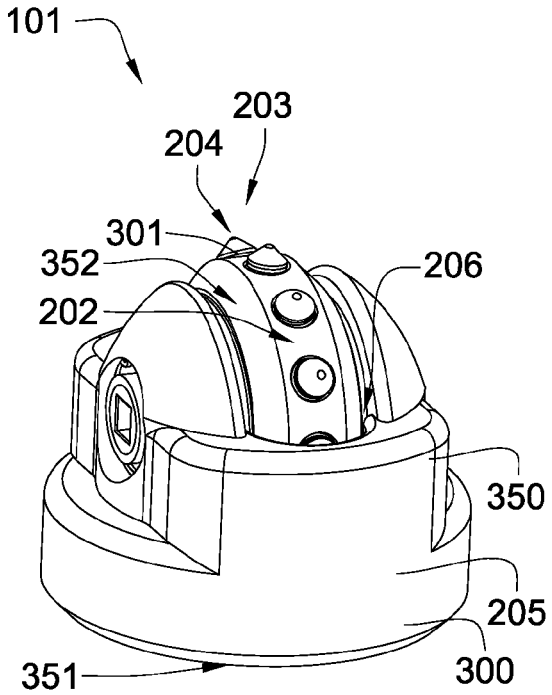
FIG. 3 is a perspective diagram of an embodiment of roller assembly.

FIG. 3 is perspective diagram of an embodiment of a roller assembly 101. The roller assembly 101 may comprise a housing 205 with a substantially wide base 300 that may facilitate an attachment to the chain driven assembly (not shown). The base 300 may comprise a chamfer 351. The chamfer 351 may accommodate welding the housing 205 to the chain driven assembly. The base 300 may be welded to the chain driven assembly. The housing 205 may further comprise a debris guard 350 that extends from the chain driven assembly to at least one-third the roller assembly 101. The debris guard 350 may prevent wear on the roller assembly 101. The housing 205 may also comprise a hole (not shown) in the center of the base 300 that may be used for welding purposes. The housing 205 may also comprise a substantially smooth finish along the outside of the housing 205. This smooth finish may reduce wear on the housing 205 and give the roller assembly 101 a geometry that facilitates the cutting formations. The wheel 202 may comprise an exterior chamfer 352 as well that facilitates the cutting of formations and reduces wear.

The roller assembly 101 may also comprise pointed inserts 203. The pointed inserts 203 comprise a carbide core 301 attached to an impact tip 204 and is press fit into the wheel 202. In other embodiments, the carbide core 301 may also be brazed onto the exterior of the wheel 202. The carbide core 301 may comprise a tapered end (not shown) opposite the impact tip 204. It is believed that such geometry reduces stress risers in the roller assembly 101.

Figure 4:
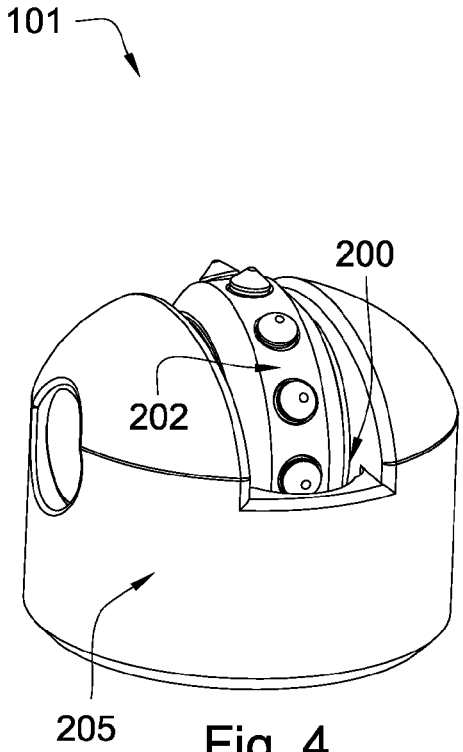
FIG. 4 is another perspective diagram of an embodiment of a roller assembly.

FIG. 4 is another perspective diagram of an embodiment of a roller assembly 101. The roller assembly 101 may comprise a housing 205 that extends uniformly around a majority of the wheel 202. The housing 205 may protect the roller assembly 101 from wear. The wheel 202 may be the only component of the roller assembly 101 that moves. The housing 205 may comprise a saddle 206 that may allow the wheel 202 to rotate.

Figure 5:
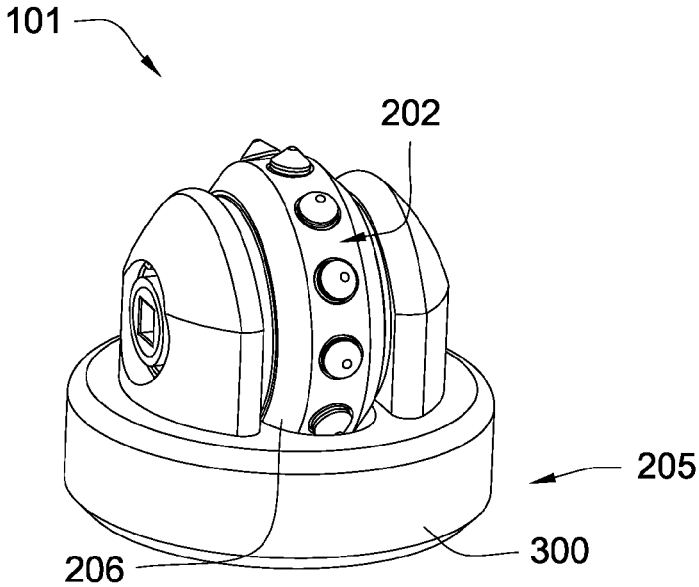
FIG. 5 is another perspective diagram of an embodiment of a roller assembly.

FIG. 5 is another perspective diagram of an embodiment of a roller assembly. The roller assembly 101 may comprise a housing 205 that comprises a uniform base 300. The housing 205 may comprise a saddle 206 that may allow the wheel 202 to rotate.

Figure 6:
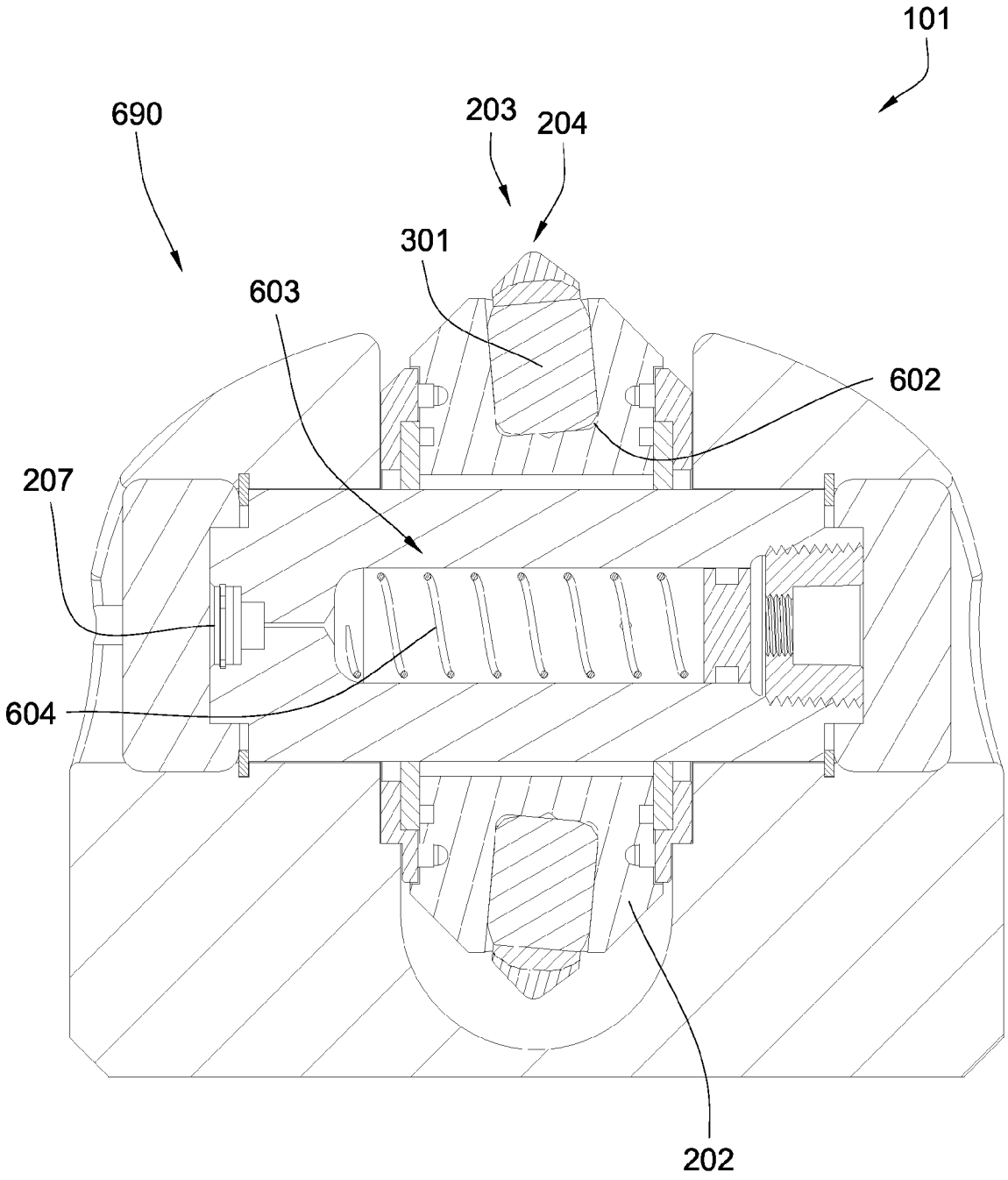
FIG. 6 is a cross-sectional diagram of an embodiment of a roller assembly.

FIG. 6 is a cross-sectional diagram of an embodiment of a roller assembly 101. The roller assembly 101 may comprise pointed inserts 203. The pointed inserts 203 may comprise a carbide core 301 attached to an impact tip 204 and may be press fit into the wheel 202. In other embodiments, the carbide may also be brazed onto the exterior of the wheel 202. The carbide core 301 may comprise a tapered end 602 opposite the impact tip 204. It is believed that such a geometry reduces stress risers in the roller assembly 101 which can result in factures. The wheel 202 comprises a central axle 207 about which it rotates. The central axle 207 may comprise an a lubrication system 690 with an internal accumulator 603. The accumulator 603 may comprise a spring 604, a filter, and a throw-away filter disc, along with an accumulator vent. In some embodiments of the present invention, the spring may be a coiled spring, closed-cell foam, compression spring, tension spring, rubber, a elastomer, or a combination thereof. The accumulator 603 may act as a lubrication system comprising oil. The oil lubricates the axle from the wheel 202 as it rotates.

Figure 7:
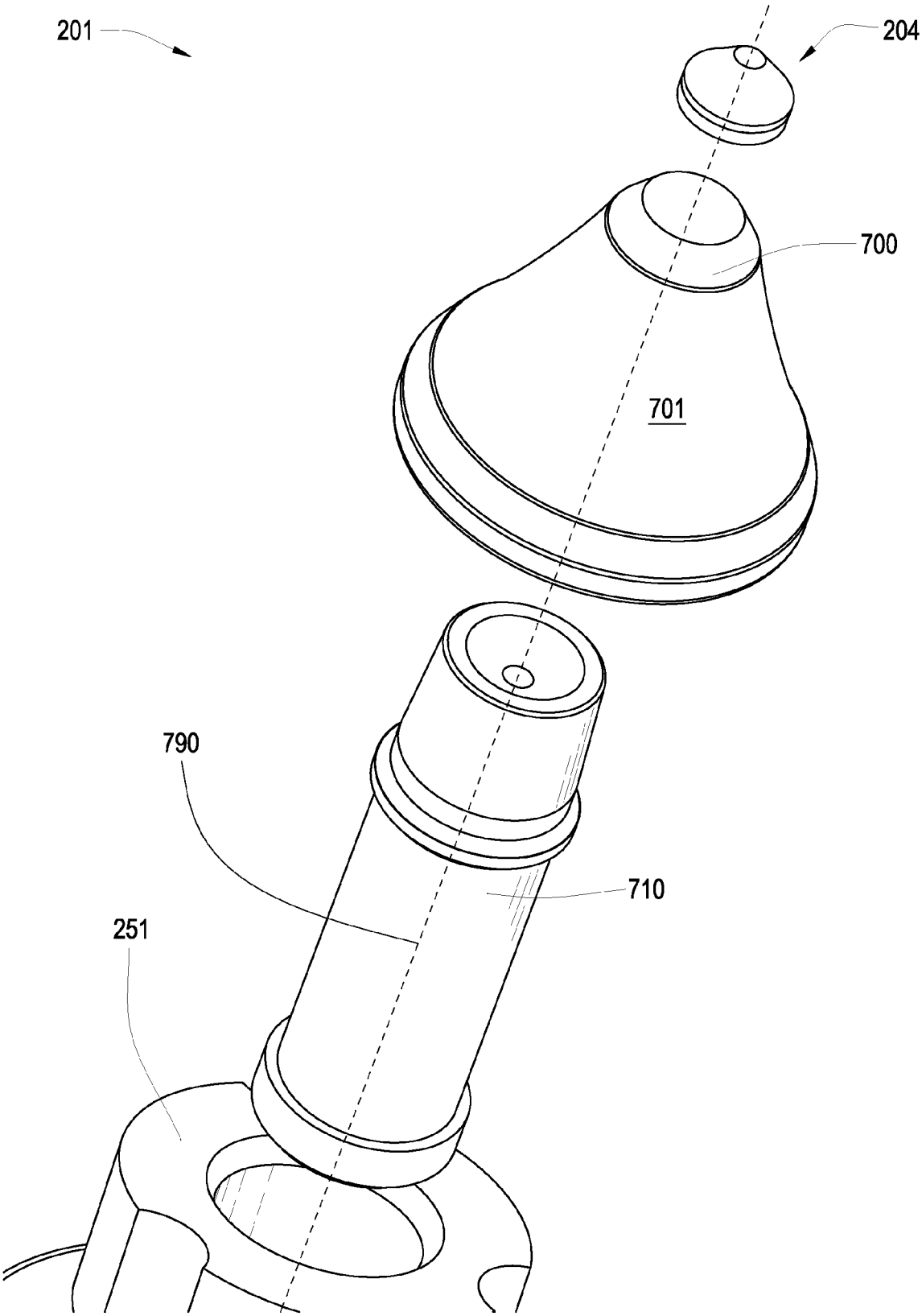
FIG. 7 is an exploded diagram of an embodiment of a pick assembly.

FIG. 7 is an exploded diagram of an embodiment of a pick assembly 201. The pick assembly 201 may comprise a super hard material bonded to a cemented metal carbide substrate 700 at a non-planar interface. Together the metal carbide substrate 700 and the super hard material form a tip 204. The cemented metal carbide substrate 700 may be bonded to a front end 203 of a cemented metal carbide bolster 701 and a shank 710 that may fit within a holder 251. The assembly 201 may also rotate along its central axis 790 within the holder 251.

Figure 8:
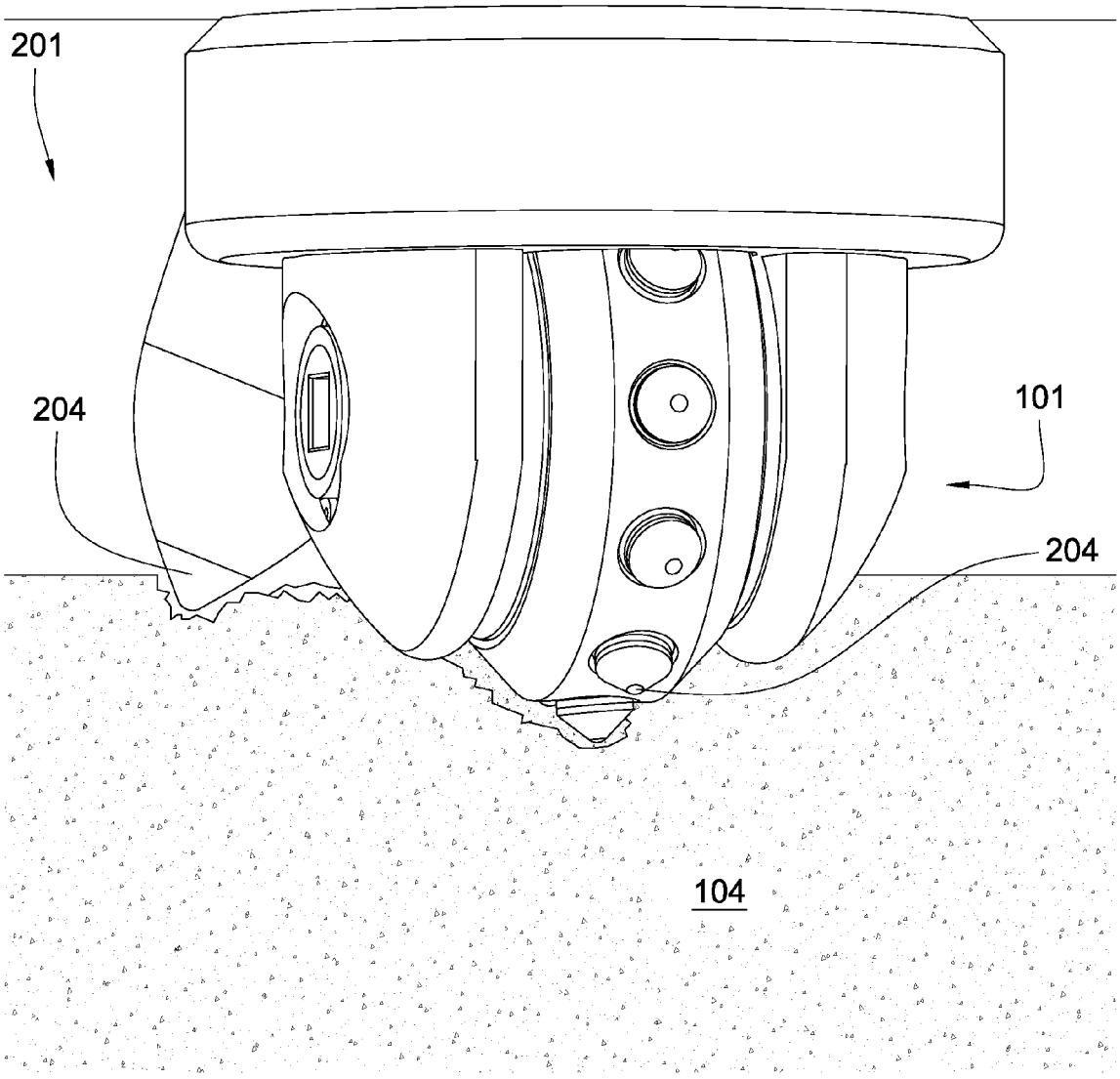
FIG. 8 is a perspective diagram of an embodiment of a pick assembly and a roller assembly.

FIG. 8 is a perspective diagram of a pick assembly 201 and a roller assembly 101. The roller assembly 101 may be offset relative to the pick assembly 201. The roller assembly 101 may create a wave geometry in the formation 104 during trenching. The pick assembly 201 may be adapted to follow the roller assembly 101 and contact and break up the wave geometry from the formation 104. The tip 204 of the pick assembly 201 may comprise the same width as the tip 204 disposed on the roller assembly 101.

Figure 9:
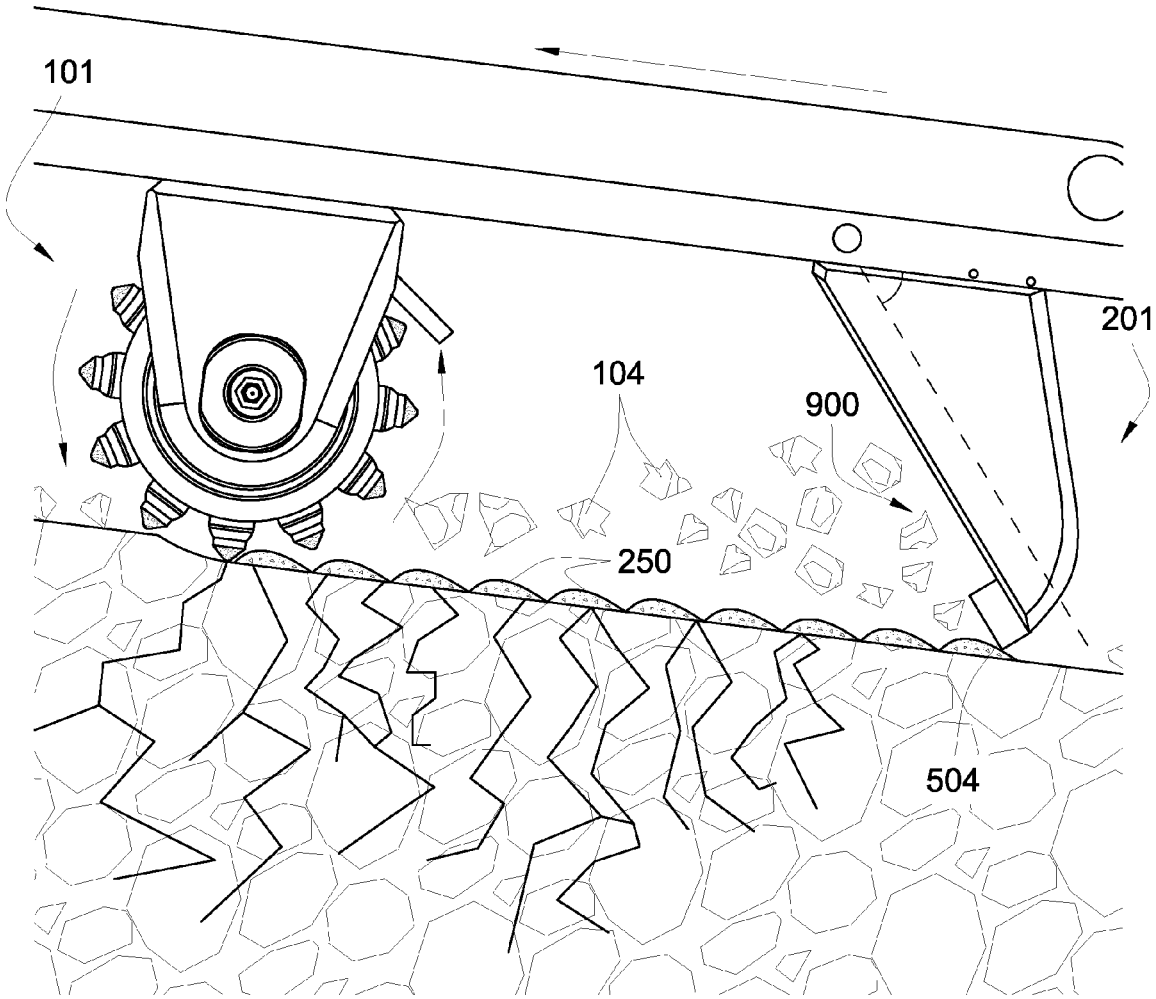
FIG. 9 is an orthogonal diagram of an embodiment of a roller assembly and a pick assembly.

FIG. 9 is a perspective diagram of an embodiment of a roller assembly 101 degrading a formation 104 along with a pick assembly 201 positioned posterior to the roller assembly 101 removing the degraded formation 104 passed over by the roller assembly 101. FIG. 9 shows the pick assembly 201 comprising a shear cutter 900 that is adapted to contact the formation 104. The roller assembly 101 may create a wave geometry 250 in the formation 104 and the shear cutter 900 may remove the wave geometry 250.

Figure 10:
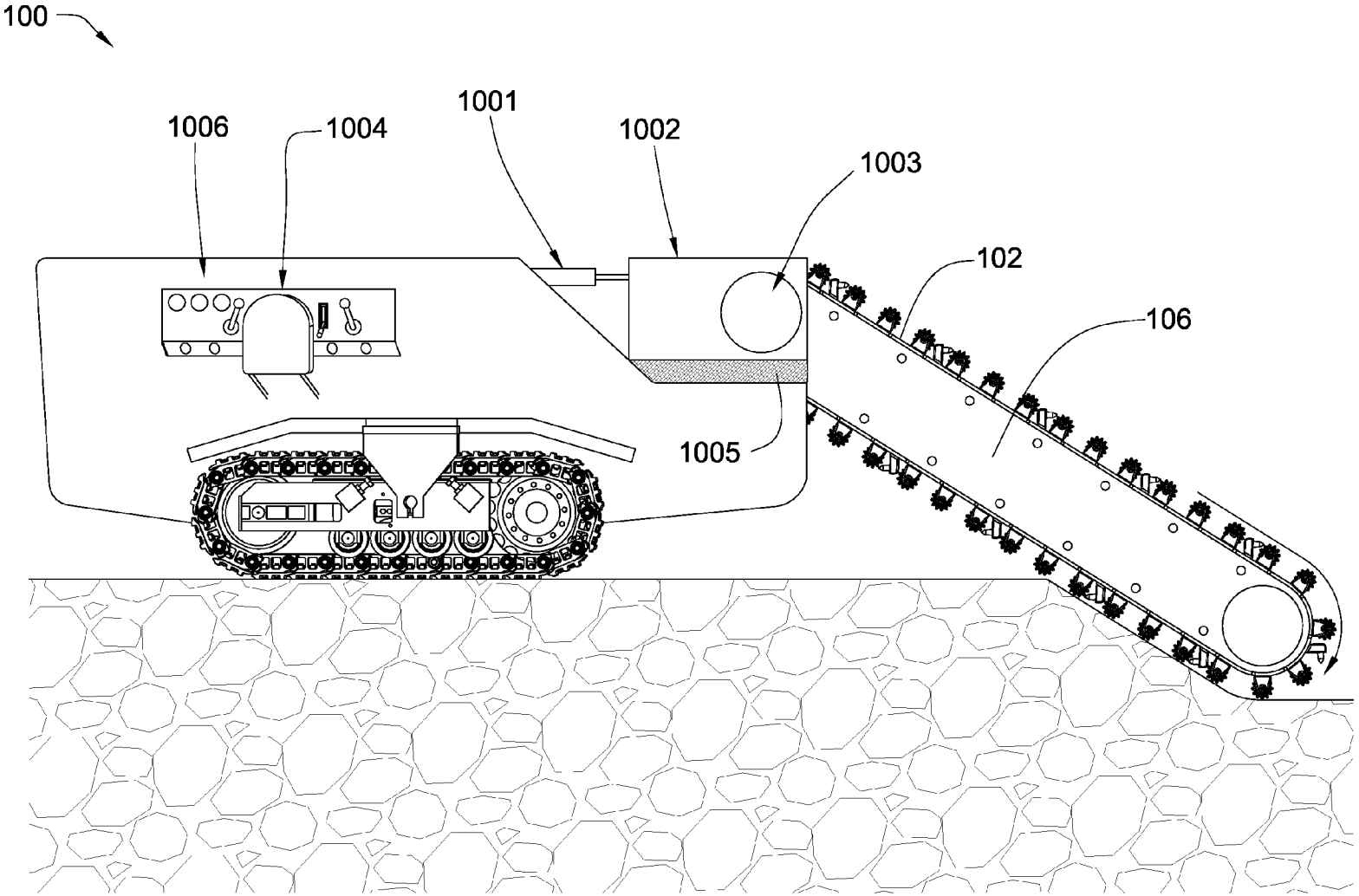
FIG. 10 is an orthogonal diagram of an embodiment of a trenching machine.

FIG. 10 is an orthogonal diagram of an embodiment of a trenching machine 100 with dampening elements 1001 which are in contact with a block 1002 on the trenching machine 100. The block 1002 comprises an axle 1003 around which an arm 106 pivots. In one embodiment the dampening element may be a hydraulic shock absorber 1001 positioned between the block 1002 and the trenching machine 100 it may dampen the vibration felt by an operator 1004 on the machine. The operator 1004 is positioned near a control panel 1006 that controls the operations of the trenching machine 100. In some embodiments the block 1002 also sits upon a dampening element such as an elastomeric material 1005. FIG. 7 also discloses one pick assembly 210 for every three roller assemblies 101. In some embodiment, a pick assembly 201 may be associated with every roller assembly 201 or in other embodiments one pick assembly 201 may be used for a plurality of roller assemblies 101. The pick assembly 201 may have a similar width to the roller assembly 101 or the pick assembly 201 may comprise a width up to the width of the chain driven assembly 102.

Figure 10A:
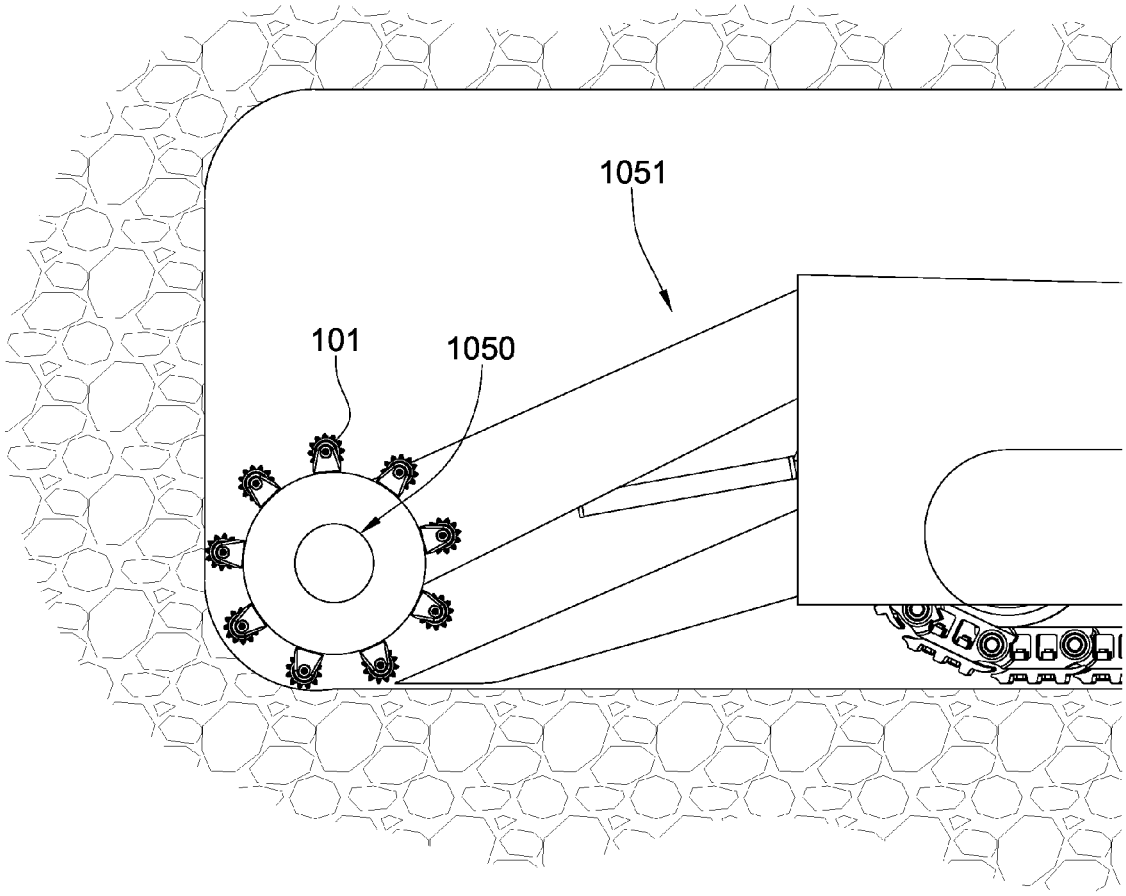
FIG. 10*a* is a orthogonal diagram of an embodiment of a mining machine.

FIG. 10*a* is a diagram of a mining machine 1051 incorporating the present invention. The mining machine 1051 comprises a drum 1050 with a plurality of the roller assemblies 101. No pick assemblies are shown in this embodiment, although it is within the scope of the claims to have such. As the mining machine 1051 moves forward the roller assemblies 101 apply a compressive force on the formation through the roller assemblies 101.

Figure 11:
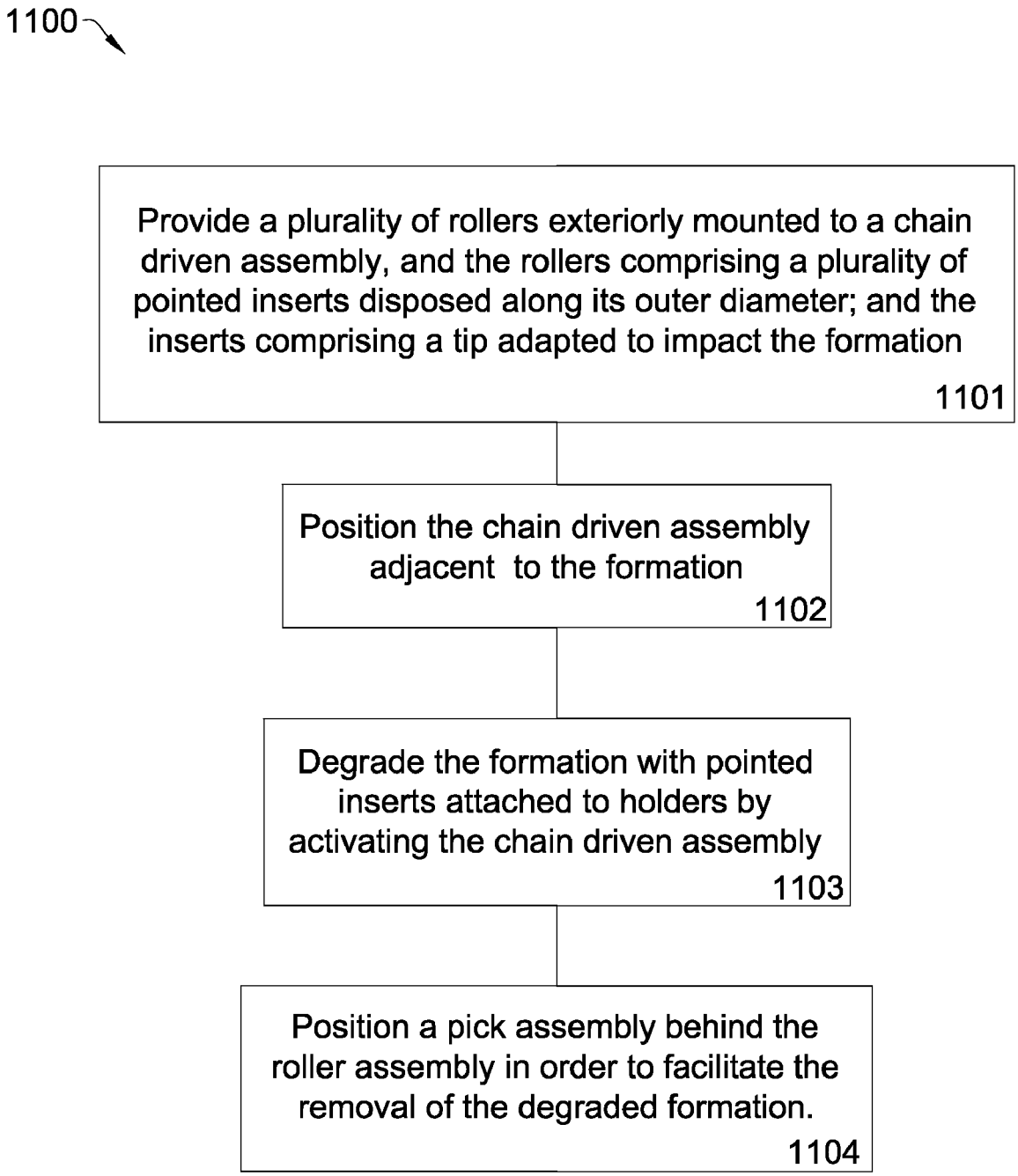
FIG. 11 is a method of degrading natural or man-made formations disclosed in the form of a flowchart.

FIG. 11 is a method of degrading natural or manmade formations disclosed in the form of a flowchart. The method comprises a step of providing a plurality of roller assemblies exteriorly mounted to a chain driven assembly. The roller assemblies comprising a plurality of pointed inserts disposed along its outer diameter. The pointed inserts comprising a tip adapted to impact the formation. The method further comprises a step of positioning the chain driven assembly adjacent to the formation. The method further comprises a step of degrading the formation with the pointed inserts attached to holders by activating the chain driven assembly. The method further comprises a step of positioning pick assemblies directly behind the roller assemblies in order to facilitate the removal of the degraded formation.

Whereas the present invention has been described in particular relation to the drawings attached hereto, it should be understood that other and further modifications apart from those shown or suggested herein, may be made within the scope and spirit of the present invention.

What is claimed is:

1. A excavator for degrading natural and man-made formations, comprising:

a roller assembly comprising a plurality of pointed inserts disposed along an outer diameter;

at least one of the inserts comprising a tip adapted to impact the formation;

at least one of the tips comprising polycrystalline diamond bonded to a cemented metal carbide segment;

the diamond comprising a substantially conical geometry with a 0.50 to 0.200 inch radius and comprising a thickness greater than 0.100 inches at an apex; and the diamond also comprising a volume that is 75 to 150 percent of a volume of the carbide segment.

2. The excavator of claim 1, wherein the roller assembly is exteriorly mounted on a drum.

3. The excavator of claim 1, wherein the roller assembly is exteriorly mounted on a chain.

4. The excavator of claim 1, comprising a pick assembly mounted proximate the roller assembly and comprising a shank and a tip on a central axis.

5. The excavator of claim 4, wherein the pick assembly comprises a superhard material selected from the group consisting of cubic boron nitride, diamond, diamond like material, or combinations thereof.

6. The excavator of claim 4, wherein the pick assembly is adapted to contact the formation after the roller assembly.

7. The excavator of claim 4, wherein the pick assembly is disposed in a holder that comprises a taper that increases from the bottom portion of the pick assembly and is adapted to pass through the formation.

8. The excavator of claim 4, wherein the pick assembly and/or roller assembly are bolted, welded, or combination thereof to a chain.

9. The excavator of claim 4, wherein the pick assembly comprises a spring mechanism.

10. The excavator of claim 4, wherein the pick assembly comprises a negative rake angle.

11. The excavator of claim 4, wherein the pick assembly comprises a bottom portion opposite an end with a pointed geometry with a space intermediate the bottom portion and a holder.

12. The excavator of claim 11, wherein the the shank and the tip rotate along a central axis of the pick within the holder.

13. The excavator of claim 4, wherein the roller assembly comprises a lubrication system.

14. The excavator of claim 4, wherein the pick assembly comprises a lubrication system.

15. The excavator of claim 4, wherein the pick assembly comprises a shear cutter adapted to contact the formation.

16. The excavator of claim 4, wherein the pick assembly and roller assembly are connected to a single link of a chain.

17. The excavator of claim 16, wherein the roller assembly comprises a housing with a debris guard that extends from the link to at least one-third of roller assembly.

18. The excavator of claim 4, wherein the excavator is a mining machine, a trenching machine, or an asphalt milling machine.

19. The excavator of claim 4, wherein the roller assembly is offset relative to the pick assembly.

* * * * *